US010657883B2

(12) United States Patent
Sun et al.

(10) Patent No.: US 10,657,883 B2
(45) Date of Patent: May 19, 2020

(54) PIXEL DRIVING CIRCUIT, DRIVING METHOD, ARRAY SUBSTRATE AND DISPLAY APPARATUS

(71) Applicant: BOE Technology Group Co., Ltd., Beijing (CN)

(72) Inventors: Liang Sun, Beijing (CN); Ying Wang, Beijing (CN); Tuo Sun, Beijing (CN); Zhanjie Ma, Beijing (CN); Lintao Zhang, Beijing (CN); Lujiang Huangfu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/648,670

(22) PCT Filed: Sep. 30, 2014

(86) PCT No.: PCT/CN2014/087936
§ 371 (c)(1),
(2) Date: May 29, 2015

(87) PCT Pub. No.: WO2015/188532
PCT Pub. Date: Dec. 17, 2015

(65) Prior Publication Data

US 2016/0253959 A1 Sep. 1, 2016

(30) Foreign Application Priority Data

Jun. 13, 2014 (CN) ..... 2014 1 0265420

(51) Int. Cl.
*G09G 3/3225* (2016.01)
*G09G 3/3233* (2016.01)
*G09G 3/20* (2006.01)

(52) U.S. Cl.
CPC ..... *G09G 3/3225* (2013.01); *G09G 3/2003* (2013.01); *G09G 3/3233* (2013.01);
(Continued)

(58) Field of Classification Search
CPC .. G09G 3/3225; G09G 3/3233; G09G 3/2003; G09G 2300/0861;
(Continued)

(56) References Cited

U.S. PATENT DOCUMENTS 6,919,871 B2 * 7/2005 Kwon ..... G09G 3/325 345/90
7,978,156 B2 * 7/2011 Kim ..... G09G 3/3233 315/169.3

(Continued)

FOREIGN PATENT DOCUMENTS

CN 102222465 A 10/2011
CN 102411893 A 4/2012

(Continued)

OTHER PUBLICATIONS

Apr. 22, 2016—(CN)—First Office Action Appn 201410265420.2 with English Tran.

(Continued)

*Primary Examiner* — Jeff Piziali
(74) *Attorney, Agent, or Firm* — Banner & Witcoff, Ltd.

(57) ABSTRACT

There provide a pixel driving circuit and driving method thereof, an array substrate and display apparatus, wherein the pixel driving circuit comprises: a data line; a gate line; a first power supply line; a second power supply line; a light emitting device connected to the second power supply line; a driving transistor connected to the first power supply line; a storage capacitor having a first terminal connected to a gate of the driving transistor and configured to transfer information including the data voltage to the gate of the driving (Continued)

transistor; a resetting unit configured to reset a voltage across the storage capacitor as a predetermined signal voltage; a data writing unit configured to write information including the data voltage into the second terminal of the storage capacitor; a compensating unit configured to write information including a threshold voltage of the driving transistor and information of the first power supply voltage into the first terminal of the storage capacitor; and a light emitting control unit connected to the storage capacitor, the driving transistor and the light emitting device, and configured to control the driving transistor to drive the light emitting device to emit light.

17 Claims, 2 Drawing Sheets

(52) U.S. Cl.
CPC ..... *G09G 2300/0819* (2013.01); *G09G 2300/0861* (2013.01); *G09G 2310/0251* (2013.01); *G09G 2310/0262* (2013.01); *G09G 2320/0223* (2013.01); *G09G 2320/0233* (2013.01); *G09G 2320/043* (2013.01); *G09G 2330/028* (2013.01)

(58) Field of Classification Search
CPC ... G09G 2310/0251; G09G 2300/0819; G09G 2320/0223; G09G 2320/043; G09G 2310/0262; G09G 2320/0233; G09G 2330/028
See application file for complete search history.

(56) References Cited

U.S. PATENT DOCUMENTS 8,537,077 B2 * 9/2013 Lee ..... G09G 3/3233 315/169.3
8,552,938 B2 * 10/2013 Lee ..... G09G 3/3233 315/169.3
8,570,249 B2 * 10/2013 Han ..... G09G 3/3233 345/213
8,810,485 B2 * 8/2014 Lee ..... G09G 3/3233 315/169.3
9,251,737 B2 * 2/2016 Sun ..... G09G 3/3208
9,378,668 B2 * 6/2016 Han ..... G09G 3/003
2002/0070913 A1 * 6/2002 Kimura ..... G09G 3/3233 345/92
2003/0197663 A1 * 10/2003 Lee ..... G09G 3/3233 345/76
2004/0056828 A1 * 3/2004 Choi ..... G09G 3/3233 345/82
2005/0243036 A1 * 11/2005 Ikeda ..... G09G 3/3233 345/76
2007/0040772 A1 2/2007 Kim
2012/0235972 A1 * 9/2012 Liu ..... G09G 3/3233 345/211
2015/0009199 A1 * 1/2015 In ..... G09G 3/3266 345/212

FOREIGN PATENT DOCUMENTS

CN 102956185 A 3/2013
CN 103021338 A 4/2013
CN 103077680 A 5/2013
CN 103226931 A 7/2013
CN 203882587 U 10/2014
JP 2005128521 A 5/2005
KR 20100045578 A 5/2010

OTHER PUBLICATIONS

Mar. 23, 2015—International Search Report and Written Opinion for Appn PCT/CN2014/087936 with English Tran.
Aug. 16, 2016—(CN)—Second Office Action Appn 201410265420.2 with English Tran.

* cited by examiner

PIXEL DRIVING CIRCUIT, DRIVING METHOD, ARRAY SUBSTRATE AND DISPLAY APPARATUS

The application is a U.S. National Phase Entry of International Application No. PCT/CN2014/087936 filed on Sep. 30, 2014, designating the United States of America and claiming priority to Chinese Patent Application No. 201410265420.2 filed on Jun. 13, 2014. The present application claims priority to and the benefit of the above-identified applications and the above-identified applications are incorporated by reference herein in their entirety.

TECHNICAL FIELD

The present disclosure relates to a pixel driving circuit, a driving method, an array substrate and a display apparatus.

BACKGROUND

An organic light emitting diode (OLED), as a current type light emitting device, has been increasingly applied to a high-performance active matrix organic light emitting display. A traditional passive matrix organic light emitting display requires a shorter driving time of a single pixel as its display size increases, and thus requires increasing the transient current, which causes an increase of power consumption. At the same time, application of a large current would cause excessive voltage drop of an indium tin oxide metal oxide line and make the operating voltage of OLED too high, thereby reducing its efficiency. The active matrix organic light emitting display (AMOLED) scans progressively through switching transistors to input the OLED current, which can solve these problems well.

In the pixel circuit design of AMOLED, the major problem needed to be solved is the luminance non-uniformity of an OLED device driven by respective AMOLED pixel driving units.

First, AMOLED adopts thin film transistors (TFT) to construct a pixel driving unit to supply a corresponding driving current to the light emitting device. As well known in the art, low temperature poly silicon thin film transistors or oxide thin film transistors are mostly used. Compared with a general amorphous-silicon thin film transistor, the low temperature poly silicon thin film transistor and the oxide thin film transistor have a higher mobility and a more stable characteristic, and are more suitably applicable to AMOLED display. However, due to limitation of crystallization technique, the low temperature poly silicon thin film transistor manufactured on a large-size glass substrate always has non-uniformity in electrical parameters such as threshold voltage, mobility and so on. Such non-uniformity would be converted into differences in driving current and luminance of the OLED device and sensed by human eyes, i.e., phenomenon of Mura color. Although the oxide thin film transistor has a better process, as similar as the amorphous-silicon thin film transistor, the threshold voltage of the oxide thin film transistor will drift under pressure and high temperature for a long time. Since display pictures are different, the threshold voltage drift of thin film transistors in respective parts of the panel is different, which would cause difference in display luminance. Such difference is always presented as an image sticking phenomenon because it is related to images previously displayed.

Since the light emitting device of OLED is a current-driven device, in the pixel driving unit that drives the light emitting device to emit light, the threshold characteristic of its driving transistor has a great impact on the driving current and the final displayed luminance. The driving transistor would make its threshold voltage drift when being under voltage stress and being illuminated. Such threshold voltage drift will be reflected as luminance non-uniformity in display effect.

In addition, in order to eliminate influence caused by threshold voltage difference of the driving transistor, the design of the configuration of the pixel circuit in the pixel circuit of the existing AMOLED is generally more complex, which directly results in a decrease of production yield of the pixel circuit of AMOLED.

Therefore, in order to solve the above problem, the present disclosure has an urgent need for providing a pixel driving unit and a driving method thereof, and a pixel circuit.

SUMMARY

According to one aspect of the present disclosure, there is provided a pixel driving circuit, comprising: a data line for providing a data voltage; a gate line for providing a scanning voltage; a first power supply line for providing a first power supply voltage; a second power supply line for providing a second power supply voltage; a light emitting device connected to the second power supply line; a driving transistor connected to the first power supply line; a storage capacitor having a first terminal connected to a gate of the driving transistor and configured to transfer information including the data voltage to the gate of the driving transistor; a resetting unit configured to reset a voltage across two terminals of the storage capacitor as a predetermined signal voltage; a data writing unit connected to the gate line, the data line and a second terminal of the storage capacitor and configured to write the information including the data voltage into the second terminal of the storage capacitor; a compensating unit connected to the gate line, the first terminal of the storage capacitor and the driving transistor and configured to write information including a threshold voltage of the driving transistor and information of the first power supply voltage into the first terminal of the storage capacitor; a light emitting control unit connected to the storage capacitor, the driving transistor and the light emitting device and configured to control the driving transistor to drive the light emitting device to emit light, wherein the driving transistor is configured to control magnitude of current flowing into the light emitting device according to information including the data voltage, the threshold voltage of the driving transistor and the first power supply voltage under a control of the light emitting control unit.

Alternatively, the resetting unit comprises a resetting control line, a resetting signal line, a first transistor and a second transistor, wherein the first transistor has a gate connected to the resetting control line, a source connected to the resetting signal line and a drain connected to the first terminal of the storage capacitor, and is configured to write a resetting signal line voltage into the first terminal of the storage capacitor; and the second transistor has a gate connected to the resetting control line, a source connected to the data line and a drain connected to the second terminal of the storage capacitor, and is configured to write the data voltage into the second terminal of the storage capacitor.

Alternatively, the first transistor and the second transistor are P type transistors.

Alternatively, the data writing unit comprises a fourth transistor having a gate connected to the gate line, a source is connected to the data line, and a drain connected to the second terminal of the storage capacitor and configured to write the data voltage into the second terminal of the storage capacitor.

Alternatively, the fourth transistor is a P type transistor.

Alternatively, the compensating unit comprises a third transistor having a gate connected to the gate line, a source connected to the first terminal of the storage capacitor, and a drain connected to the drain of the driving transistor and configured to write the information including the threshold voltage of the driving transistor and the information of the first power supply voltage into the first terminal of the storage capacitor.

Alternatively, the third transistor is a p type transistor.

Alternatively, the pixel driving circuit further comprises a compensation signal line. The light emitting control unit comprises a light emitting control line, a fifth transistor and a sixth transistor, wherein the fifth transistor has a gate connected to the light emitting control line, a source connected to the compensation signal line and a drain connected to the second terminal of the storage capacitor, and is configured to write a compensation signal line voltage into the second terminal of the storage capacitor and transfer the compensation signal line voltage to the gate of the driving transistor by the storage capacitor; and the sixth transistor has a gate connected to the light emitting control line, a source connected to a first terminal of the light emitting device and a drain connected to the drain of the driving transistor, and is configured to control the light emitting device to emit light, the driving transistor being configured to control the magnitude of the current flowing into the light emitting device according to the information including the data voltage, the threshold voltage of the driving transistor, the first power supply voltage and the compensation signal voltage under the control of the light emitting control unit.

Alternatively, the light emitting control unit comprises a light emitting control line, a fifth transistor and a sixth transistor, wherein the fifth transistor has a gate connected to the light emitting control line, a source connected to the first power supply line and a drain connected to the second terminal of the storage capacitor, and is configured to write the first power supply voltage into the second terminal of the storage capacitor and transfer the first power supply voltage to the gate of the driving transistor by the storage capacitor; and the sixth transistor has a gate connected to the light emitting control line, a source connected to the first terminal of the light emitting device and a drain connected to the drain of the driving transistor, and is configured to control the light emitting device to emit light, the driving transistor being configured to control the magnitude of the current flowing into the light emitting device according to the information including the data voltage, the threshold voltage of the driving transistor and the first power supply voltage under the control of the light emitting control unit.

Alternatively, the fifth transistor and the sixth transistor are P type transistors.

Alternatively, the driving transistor is a P type transistor.

The present disclosure further provides a driving method of the pixel driving circuit according to any one of the above, comprising following processes: in a resetting phase, resetting the voltage across the two terminals of the storage capacitor as a predetermined voltage by the resetting unit; in a data voltage writing phase, writing the data voltage into the second terminal of the storage capacitor by the data writing unit, and writing information including the threshold voltage of the driving transistor and the information of the first power supply voltage into the first terminal of the storage capacitor by the compensating unit; in a light emitting phase, transferring information including the data voltage to the gate of the driving transistor by the storage capacitor, the driving transistor being configured to control the magnitude of the current flowing into the light emitting device according to the information including the data voltage, the threshold voltage of the driving transistor and the first power supply voltage under the control of the light emitting control unit, so as to drive the light emitting device to emit light.

Alternatively, in the resetting phase, the resetting unit resets the voltages at the two terminals of the storage capacitor as the resetting signal line voltage and the data voltage, respectively.

Alternatively, the light emitting phase further comprises: writing the compensation signal line voltage into the second terminal of the storage capacitor by the light emitting control unit, and transferring information including the compensation signal line voltage and the data voltage to the gate of the driving transistor by the storage capacitor, the driving transistor being configured to control the magnitude of the current flowing into the light emitting device according to the information including the data voltage, the threshold voltage of the driving transistor, the first power supply voltage and the compensation signal line voltage under the control of the light emitting control unit, so as to drive the light emitting device to emit light.

Alternatively, the light emitting phase further comprises: writing the first power supply voltage into the second terminal of the storage capacitor by the light emitting control unit, and transferring information including the first power supply voltage and the data voltage to the gate of the driving transistor by the storage capacitor, the driving transistor being configured to control the magnitude of the current flowing into the light emitting device according to the information including the data voltage, the threshold voltage of the driving transistor, and the first power supply voltage under the control of the light emitting control unit, so as to drive the light emitting device to emit light.

In the pixel driving unit of the embodiments of the present disclosure, through the configuration of connecting the gate and drain of the driving transistor (when the gate controlling signal is turned on, the gate and drain of the driving transistor are connected by the third switching transistor), the drain of the driving transistor is made to load the first power supply voltage together with the threshold voltage of the driving transistor to the first terminal of the storage capacitor, so as to offset the threshold voltage of the driving transistor. In this way, in the process of driving the light emitting device, it can eliminate effectively the non-uniformity caused by the threshold voltage of the driving transistor per se and the image sticking phenomenon caused by the threshold voltage drift of the driving transistor, and avoid the problem of the luminance nonuniformity of the active matrix organic light emitting display transistor due to the different threshold voltages of the driving transistor between light emitting devices of different pixel driving units in the active matrix organic light emitting display transistor. At the same time, the driving effect of the pixel driving unit for the light emitting device in raised, and the quality of the active matrix organic light emitting display transistor is further improved.

DETAILED DESCRIPTION

Specific implementations of the present disclosure will be further described below in detail by combining with the accompanying figures. Embodiments illustrated below are only used to describe the principle of the present disclosure, but not used to limit the scope of the present disclosure.

It should be noted that gate of respective transistors defined in the embodiments of the present disclosure is a terminal that controls the transistors to be turned on, and source and drain thereof are two terminals other then the gate of the transistor. Herein, the source and drain are used to describe the connecting relationship of the transistor conveniently, instead of defining the flowing trend of the current. Those skilled in the art can clearly know the operating principle and state of the transistors according to their type and signal connecting manner and so on.

First Embodiment

Figure 1:
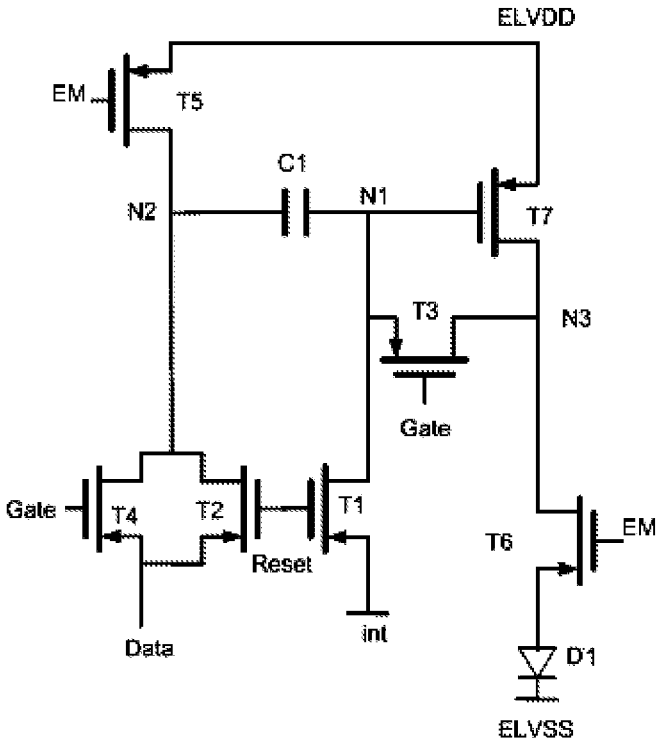
FIG. 1 is a schematic diagram of a pixel driving circuit in an embodiment of the present disclosure.

FIG. 1 illustrates a schematic diagram of a pixel driving circuit of an embodiment of the present disclosure. As shown in FIG. 1, the pixel driving circuit comprises: a data line Data, a gate line Gate, a first power supply line ELVDD, a second power supply line ELVSS, a light emitting device D, a driving transistor T7, a storage capacitor C1, a resetting unit, a data writing unit, a compensating unit and a light emitting control unit. In the circuit as shown in FIG. 1, the light emitting device D1 can be an organic light emitting diode, the data line Data is used for providing a data voltage, the gate line Gate is used for providing a scanning voltage, the first power supply line ELVDD is used for providing a first power supply voltage, and the second power supply line ELVSS is used for providing a second power supply voltage.

The resetting unit is configured to reset a voltage across the storage capacitor C1 as a predetermined voltage.

The data writing unit is connected to the gate line Gate, the data line Data and a first terminal (node N1) of the storage capacitor C1, and is configured to write information including the data voltage into the second terminal (node N2) of the storage capacitor C1.

The compensating unit is connected to the gate line Gate, the first terminal of the storage capacitor C1 and the driving transistor T7, and is configured to write information including a threshold voltage of the driving transistor and information of the first power supply voltage into the first terminal of the storage capacitor C1.

The light emitting control unit is connected to the storage capacitor C1, the driving transistor T7 and the light emitting device D, and is configured to control the driving transistor T7 to drive the light emitting device to emit light. The driving transistor T7 is connected to the first power supply line ELVDD, the light emitting device D1 is connected to the second power supply line ELVDD, and the driving transistor T7 is configured to control the current flowing into the light emitting device D1 according to the data voltage under the control of the light emitting control unit.

The first terminal N1 of the storage capacitor C1 is connected to the gate of the driving transistor T7, and is configured to transfer the information including the data voltage to the gate of the driving transistor T7.

The driving transistor T7 is connected to the first power supply line ELVDD, and the light emitting device D is connected to the second power supply line ELVSS. The driving transistor T7 is configured to control the magnitude of the current flowing into the light emitting device according to information including the data voltage, the threshold voltage of the driving transistor and the first power supply voltage under the control of the light emitting control unit.

In the pixel driving unit of the embodiment, the threshold voltage of the driving transistor is extracted by the compensating unit, and the threshold voltage of the driving transistor T7 can be offset in the process of driving the light emitting device, so as to eliminate effectively the non-uniformity caused by the threshold voltage of the driving transistor per se and image sticking phenomenon caused by the threshold voltage drift of the driving transistor, and avoid the problem of the display luminance nonuniformity due to the threshold voltage difference of the driving transistor of different pixels in the active matrix organic light emitting display device.

As shown in FIG. 1, in the present embodiment, the resetting unit comprises: a resetting control line Reset, a resetting signal line int, a first transistor T1 and a second transistor T2. The first transistor T1 has a gate connected to the resetting control line Reset, a source connected to the resetting signal line int and a drain connected to the first terminal N1 of the storage capacitor C1. The first transistor T1 is configured to write a voltage $V_{int}$ of the resetting signal line int into the first terminal N1 of the storage capacitor C1. The second transistor T2 has a gate connected to the resetting control line Reset, a source connected to the data line Data and a drain connected to the second terminal N2 of the storage capacitor C1. The second transistor T2 is configured to write a voltage $V_{data}$ of the data line Data into the second terminal N2 of the storage capacitor C1. That is, the voltages at the two terminals of the storage capacitor C1 are reset as $V_{ini}$ and $V_{dd}$ respectively. After being reset, the second terminal N of the storage capacitor C1 is a data potential, which will not be pulled down to a lower data potential. In the data voltage writing phase of the circuit, since the potential the node N2 has been written as a data potential, the potential at the node N2 will not jump in this phase, which avoids the jump of the potential at the node N2, so as to avoid the problem that the potential at the node N1 is different as the potential at the node N2 is different.

The data writing unit comprises a fourth transistor T4. The fourth transistor T4 has a gate connected to the gate line Gate, a source is connected to the data line Data, and a drain connected to the second terminal N2 of the storage capacitor C1. The fourth transistor T4 is configured to write the data voltage $V_{data}$ into the second terminal N2 of the storage capacitor C1. That is, the voltage at a node N2 is $V_{data}$.

The third transistor T3 has a gate connected to the gate line Gate, a source connected to the first terminal N1 of the storage capacitor C1, and a drain connected to the drain of the driving transistor T7. The third transistor T3 is configured to write the information including the first power supply voltage and the threshold voltage $V_{th}$ of the driving transistor T7 into the first terminal N1 of the storage capacitor C1. That is, the voltage at the node N1 is now $V_{dd}-V_{th}$.

Figure 3:
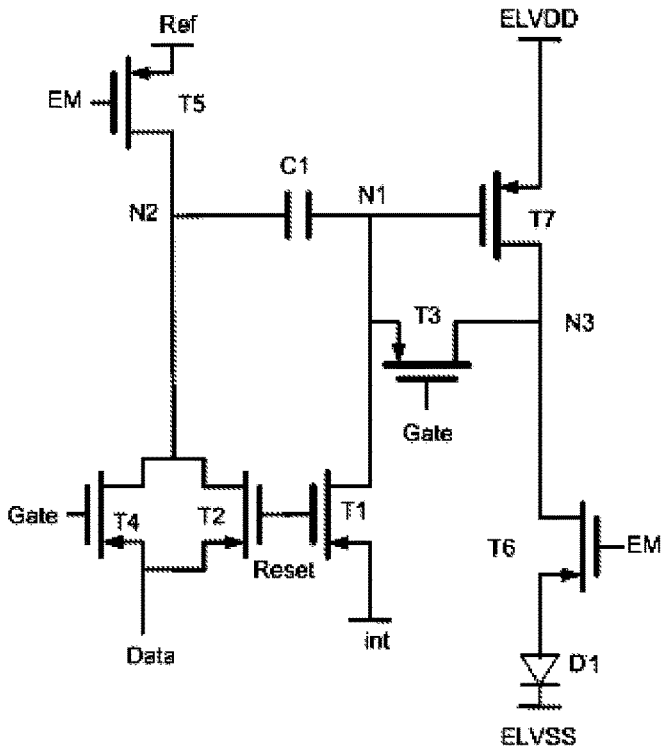
FIG. 3 is a schematic diagram of another pixel driving circuit in an embodiment of the present disclosure.

The light emitting control unit comprises a light emitting control line EM, a fifth transistor T5 and a sixth transistor T6. The fifth transistor T5 has a gate connected to the light emitting control line EM, a source connected to the first power supply line ELVDD and a drain connected to the second terminal N2 of the storage capacitor C1. The fifth transistor T5 is configured to write the first power supply voltage into the second terminal N2 of the storage capacitor C1 and transfer the first power supply voltage $V_{dd}$ to the gate of the driving transistor T7 by the storage capacitor C1. The sixth transistor T6 has a gate connected to the light emitting control line EM, a source connected to a first terminal of the light emitting device D and a drain connected to the drain of the driving transistor T7. As illustrated in FIGS. 1 and 3, the point where the drain of the sixth transistor T6, the drain of the driving transistor T7, and the drain of the third transistor T3 are connected, is referred to as a node N3. The sixth transistor T6 is configured to control the light emitting device D to emit light. That is, the driving transistor T7 can make the driving current flow into the light emitting device D only when the sixth transistor 6 is turned on. The driving transistor T7 is configured to control the current flowing into the light emitting device D according to the information including the data voltage, the threshold voltage of the driving transistor and the first power supply voltage under the control of the light emitting control unit.

In the pixel driving unit of the embodiment of the present disclosure, through the configuration of connecting the gate and drain of the driving transistor T7 (when the gate controlling signal is turned on, the gate and drain of the driving transistor T7 are connected via the third switching transistor), the threshold voltage of the driving transistor can be offset in the process of driving the light emitting device, so as to eliminate effectively the non-uniformity caused by the threshold voltage of the driving transistor per se and the image sticking phenomenon caused by the threshold voltage drift of the driving transistor, and thus avoid the problem of the luminance nonuniformity of the active matrix organic light emitting display transistor due to the threshold voltage difference of the driving transistor between light emitting devices of different pixel driving units in the active matrix organic light emitting display transistor. At the same time, the driving effect of the pixel driving unit for the light emitting device is enhanced, and the quality of the active matrix organic light emitting display transistor is raised.

Figure 2:
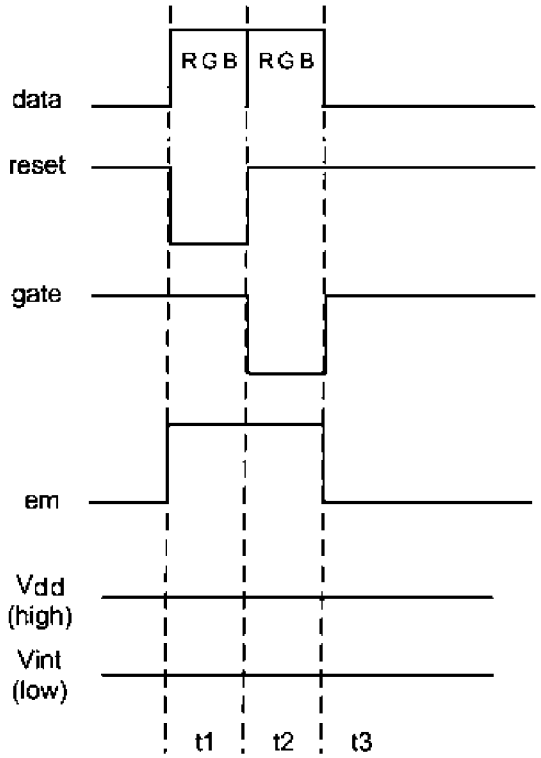
FIG. 2 is a timing diagram of the pixel driving circuit in FIG. 1.

As shown in FIG. 2, the operating process of the circuit structure of the present embodiment comprises three phases:

First phase t1: the resetting control signal Reset is active, so that the transistors T1 and T2 are turned on, and the voltage across the two terminal of the storage capacitor C1 is reset. Now, the voltage $V_{int}$ of the resetting signal line int is written into the node N1, and the data voltage $V_{data}$ is written into the node N1.

Second phase t2: the gate line signal is active, so that the transistors T3 and T4 are turned on, the data voltage $V_{data}$ is written into the node N2, and $V_{dd}-V_{th}$ is written into the node N1. Now, the voltage stored in the storage capacitor is $V_{dd}-V_{th}-V_{data}$. In this phase, the transistor T3 writes the information including the first power supply voltage and the threshold voltage of the driving transistor into the first terminal N1 of the storage capacitor C1.

Third phase t3: a signal of the light emitting control line EM is active, so that the transistors T5 and T6 are turned on. The potential at the node N2 is $V_{dd}$, and the potential at the node N1 is $V_{dd}-V_{th}-V_{data}+V_{dd}$, which is the potential at the gate of the driving transistor. A potential at the source of the driving transistor is $V_{dd}$, a gate-source voltage is $V_{dd}-V_{th}-V_{data}+V_{dd}-V_{dd}$, and the current flowing into the light emitting device is $I=\frac{1}{2}\mu C_{ox}(W/L)(V_{gs}-V_{th})^2=\frac{1}{2}\mu C_{ox}(W/L)(V_{dd}-V_{data})^2$, wherein μ is a carrier mobility, $C_{ox}$ is a gate oxide layer capacitor, and W/L is a ratio of width to length of the driving transistor.

It can be seen from the above formula of the current flowing into the light emitting device that the current I has been already unrelated to the threshold voltage $V_{th}$ of driving transistor T7, which avoids the problem of the display luminance non-uniformity caused by the different threshold voltages of the driving transistor of different pixels in the active matrix organic light emitting display device.

Second Embodiment

FIG. 3 shows a schematic diagram of a pixel driving circuit in a second embodiment of the present disclosure.

In the first embodiment, the transistor T5 is connected to the first power supply line ELVDD, and the IR drop of the first power supply line ELVDD causes the voltage $V_{dd}$ to change. Therefore, when the transistor T5 charges the second terminal (node N2) of the capacitor C1, the gate voltage of the driving transistor of different pixel units may have a difference, and the influence of a drop of $V_{dd}$ on the current would cause the problem of luminance non-uniformity of different pixels.

Therefore, the pixel driving circuit of the present embodiment further comprises a compensation signal line used to compensate for a change of the first power supply voltage.

As shown in FIG. 3, the configuration of the pixel driving circuit in the embodiment is basically the same as that in the first embodiment. The only difference is that the pixel driving circuit in the present embodiment further comprises a compensation signal line Ref. The source of the fifth transistor T5 of the light emitting unit is connected to the compensation signal line Ref. The fifth transistor T5 is configured to write a compensation signal line voltage $V_{ref}$ into the second terminal N2 of the storage capacitor C1, and the compensation signal line voltage $V_{ref}$ is transferred into the gate of the driving transistor T7 by the storage capacitor C1. The sixth transistor T6 has a gate connected to the light emitting line EM, a source connected to the first terminal of the light emitting device D1, and a drain connected to the drain of the driving transistor T7. The sixth transistor T6 is configured to control the light emitting device to emit light. The driving transistor T7 is configured to control the current flowing into the light emitting device D1 according to information including the data voltage, the threshold voltage of the driving transistor, the first power supply voltage, the change of the first power supply voltage and the compensation signal line voltage under the control of the light emitting control unit.

Figure 4:
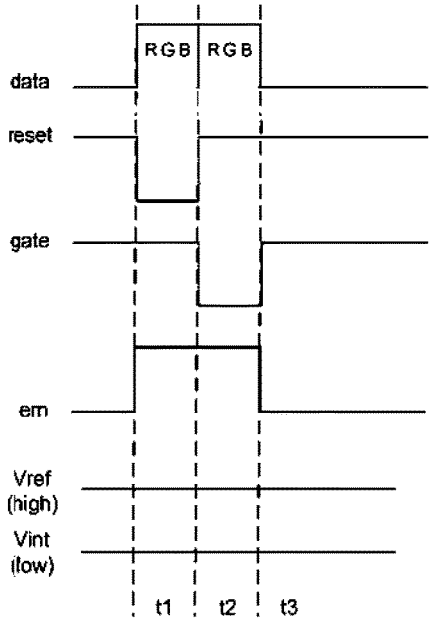
FIG. 4 is a timing diagram of the pixel driving circuit in FIG. 3.

As shown in FIG. 4, the operating process of the circuit structure of the present embodiment comprises three phases:

First phase t1: the resetting control signal Reset is active, so that the transistors T1 and T2 are turned on, and the two terminal of the storage capacitor C1 is reset. Now, the voltage $V_{int}$ of the resetting signal line int is written into the node N1, and the data voltage $V_{data}$ is written into the node N2.

Second phase t2: the gate line signal is active, so that the transistors T3 and T4 are turned on, the data voltage $V_{data}$ is written into the node N2, and $V_{dd}-V_{th}$ is written into the node N1. Now, the voltage stored in the storage capacitor C1 is $V_{dd}-V_{th}-V_{data}$. In this phase, the transistor T3 writes the information including the first power supply voltage and the threshold voltage of the driving transistor into the first terminal of the storage capacitor C1.

Third phase t3: a signal of the light emitting control line EM is active, so that the transistors T5 and T6 are turned on. In contrast to the first embodiment, the transistor T5 is connected to the compensation signal line Ref. The potential at the node N2 is $V_{ref}$, and the potential at the node N1 is $V_{dd}-V_{th}-V_{data}+V_{ref}$, which is the potential at the gate of the driving transistor. A potential at the source of the driving transistor is $V_{dd}$, a gate-source voltage $V_{gs}$ is $V_{dd}-V_{th}-V_{data}+V_{ref}-V_{dd}$, and the current flowing into the light emitting device is $I=\frac{1}{2}\mu C_{ox}(W/L)(V_{gs}-V_{th})^2=\frac{1}{2}\mu C_{ox}(W/L)(V_{ref}-V_{data})^2$, where μ is a carrier mobility, $C_{ox}$ is a gate oxide layer capacitor, and W/L is a ratio of width to length of the driving transistor.

It can be seen from the above formula of the current flowing into the light emitting device that the current I has been already unrelated to the threshold voltage $V_{th}$ of driving transistor T7, which avoids the problem of the display luminance non-uniformity caused by the different threshold voltages of the driving transistor of different pixels in the active matrix organic light emitting display device. Furthermore, the current I is unrelated to $V_{dd}$, and $V_{ref}$ just charges the storage capacitor. As the current over a corresponding line is smaller, the voltage drop is smaller. The storage capacitor C1 is connected to the gate of the driving transistor, and because $V_{ref}$ is more stable than $V_{dd}$, the gate voltage of the driving transistor is more stable. Compared with the mode of charging the capacitor by $V_{dd}$ (the first embodiment), the problem of the luminance non-uniformity of different pixels caused by the influence of the drop of $V_{dd}$ on the current.

The driving transistor, the first transistor, the second transistor, the third transistor, the fourth transistor, the fifth transistor and the sixth transistor in the first and second embodiments described above are P type transistors. Of course, they can be also N type transistors or a combination of P type and N type transistors, only the active signal of the gate control signal line is different.

Third Embodiment

The present disclosure provides a pixel driving method of the pixel driving circuit of the first embodiment or the second embodiment, comprising following processes:

in a resetting phase, resetting a voltage across the storage capacitor as a predetermined voltage by the resetting unit;

in a data voltage writing phase, writing a data voltage into the second terminal of the storage capacitor by the data writing unit, and writing information including the threshold voltage of the driving transistor and information of the first power supply voltage into the first terminal of the storage capacitor by the compensating unit;

in a light emitting phase, transferring information including the data voltage to the gate of the driving transistor by the storage capacitor, the driving transistor being configured to control the magnitude of the current flowing into the light emitting device to drive the light emitting device to emit light according to the information including the data voltage, the threshold voltage of the driving transistor and the first power supply voltage under the control of the light emitting control unit.

In the resetting phase, the resetting unit resets the voltage at the two terminals of the storage capacitor as the resetting signal line voltage and the data voltage respectively.

For the circuit of the first embodiment, the light emitting phase further comprises: writing the first power supply voltage into the second terminal of the storage capacitor by the light emitting control unit, and transferring information including the first power supply voltage and the data voltage to the gate of the driving transistor by the storage capacitor, the driving transistor being configured to control the magnitude of the current flowing into the light emitting device according to the information including the data voltage, the threshold voltage of the driving transistor, and the first power supply voltage under the control of the light emitting control unit, so as to drive the light emitting device to emit light.

For the circuit of the second embodiment, the light emitting phase further comprises: writing the compensation signal line voltage into the second terminal of the storage capacitor by the light emitting control unit, and transferring information including the compensation signal line voltage and the data voltage to the gate of the driving transistor by the storage capacitor, the driving transistor being configured to control the magnitude of the current flowing into the light emitting device to drive the light emitting device to emit light according to the information including the data voltage, the threshold voltage of the driving transistor, the first power supply voltage and the compensation signal line voltage under the control of the light emitting control unit.

Other steps of the pixel driving method can refer to the description of the three operating phases of the first and second embodiments, and thus details are not further given herein.

Fourth Embodiment

There provides in an embodiment of the present disclosure an array substrate comprising the pixel driving circuit of the first embodiment or the second embodiment.

Fifth Embodiment

There provides in an embodiment of the present disclosure a display apparatus including the array substrate of the fourth embodiment. The display apparatus can be any product or element having the function of displaying, such as an AMOLED panel, a television, a digital photo frame, a mobile phone and a tablet computer and the like.

The implementations described above are just used to describe the principle of the present disclosure, but not used to limit the protection scope of the present disclosure. Those ordinary skilled in the art can make various alternations and modifications without departing from the spirit and scope of the technical solutions in the present disclosure. These alternations and modifications as well as the equivalent technical solutions thereof belong to the scope of the present disclosure. The patent protection scope of the present disclosure is defined by the claims.

The present application claims the priority of a Chinese patent application No. 201410265420.2 filed on Jun. 13, 2014. Herein, the content disclosed by the Chinese patent application is incorporated in full by reference as a part of the present disclosure.

What is claimed is:

1. A pixel driving circuit, comprising:

a data line for providing a data voltage;

a gate line for providing a scanning voltage;

a first power supply line for providing a first power supply voltage;

a second power supply line for providing a second power supply voltage;

a light emitting device having a first terminal and a second terminal, wherein the second terminal of the light emitting device is connected to the second power supply line;

a driving transistor having a gate, a source, and a drain, wherein the source of the driving transistor is connected to the first power supply line;

a storage capacitor having a first terminal and a second terminal, wherein the first terminal of the storage capacitor is connected to the gate of the driving transistor so as to transfer the data voltage to the gate of the driving transistor;

a resetting sub-circuit configured to reset voltages at the first terminal and the second terminal of the storage capacitor to a resetting signal line voltage and to the data voltage, respectively;

a data writing sub-circuit connected to the gate line, the data line, and the second terminal of the storage capacitor and configured to write the data voltage into the second terminal of the storage capacitor;

a compensating sub-circuit it connected to the gate line, the first terminal of the storage capacitor, and the drain of the driving transistor and configured to write a compensation voltage into the first terminal of the storage capacitor, wherein the compensation voltage is equal to a difference between the first power supply voltage and a threshold voltage of the driving transistor; and a light emitting control sub-circuit connected to the second terminal of the storage capacitor, the drain of the driving transistor, and the first terminal of the light emitting device and configured to control the driving transistor to drive the light emitting device to emit light, wherein the driving transistor is configured to control, under a control of the light emitting control sub-circuit, a magnitude of a current flowing into the light emitting device, wherein the resetting sub-circuit, comprises a resetting control line, a resetting signal line, a first transistor, and a second transistor, wherein the first transistor has a gate, a source, and a drain, wherein the gate of the first transistor is connected to the resetting control line, the source of the first transistor is connected to the resetting signal line, and the drain of the first transistor is connected to the first terminal of the storage capacitor, wherein the first transistor is configured to write the resetting signal line voltage into the first terminal of the storage capacitor, wherein the second transistor has a gate, a source, and a drain, wherein the gate of the second transistor is connected to the resetting control line, the source of the second transistor is connected to the data line, and the drain of the second transistor is connected to the second terminal of the storage capacitor, and wherein the second transistor is configured to write the data voltage into the second terminal of the storage capacitor.

2. The pixel driving circuit according to claim 1, wherein the first transistor and the second transistor are P-type thin-film transistors.

3. The pixel driving circuit according to claim 1, wherein the data writing sub-circuit comprises a third transistor having a gate, a source, and a drain, wherein the gate of the third transistor is connected to the gate line, the source of the third transistor is connected to the data line, and the drain of the third transistor is connected to the second terminal of the storage capacitor, and wherein the third transistor is configured to write the data voltage into the second terminal of the storage capacitor.

4. The pixel driving circuit according to claim 3, wherein the third transistor is a P-type thin-film transistor.

5. The pixel driving circuit according to claim 1, wherein the compensating sub-circuit comprises a compensating transistor having a gate, a source, and a drain, wherein the gate of the compensating transistor is connected to the gate line, the source of the compensating transistor is connected to the first terminal of the storage capacitor, and the drain of the compensating transistor is connected to the drain of the driving transistor, and wherein the compensating transistor is configured to write the compensation voltage into the first terminal of the storage capacitor.

6. The pixel driving circuit according to claim 5, wherein the compensating transistor is a P-type thin-film transistor.

7. The pixel driving circuit according to claim 3, further comprising a compensation signal line, wherein the light emitting control sub-circuit comprises a light emitting control line, a first light-emitting controlling transistor, and a second light-emitting controlling transistor, wherein the first light-emitting controlling transistor has a gate, a source, and a drain, wherein the gate of the first light-emitting controlling transistor is connected to the light emitting control line, the source of the first light-emitting controlling transistor is connected to the compensation signal line, and the drain of the first light-emitting controlling transistor is connected to the second terminal of the storage capacitor, and is configured to write a compensation signal line voltage into the second terminal of the storage capacitor and transfer the compensation signal line voltage to the gate of the driving transistor by the storage capacitor; and the second light-emitting controlling transistor has a gate, a source, and a drain, wherein the gate of the second light-emitting controlling transistor is connected to the light emitting control line, the source of the second light-emitting controlling transistor is connected to the first terminal of the light emitting device, and the drain of the second light-emitting controlling transistor is connected to the drain of the driving transistor, and is configured to control the light emitting device to emit light, the driving transistor being configured to control the magnitude of the current flowing into the light emitting device under the control of the light emitting control sub-circuit.

8. The pixel driving circuit according to claim 3, wherein the light emitting control sub-circuit comprises a light emitting control line, a first light-emitting controlling transistor, and a second light-emitting controlling transistor, wherein the first light-emitting controlling transistor has a gate, a source, and a drain, wherein the gate of the first light-emitting controlling transistor is connected to the light emitting control line, the source of the first light-emitting controlling transistor is connected to the first power supply line and the drain of the first light-emitting controlling transistor is connected to the second terminal of the storage capacitor, wherein the first light-emitting controlling transistor is configured to write the first power supply voltage into the second terminal of the storage capacitor and transfer the first power supply voltage to the gate of the driving transistor by the storage capacitor, and wherein the second light-emitting controlling transistor has a gate, a source, and a drain, wherein the gate of the second light-emitting controlling transistor is connected to the light emitting control line, the source of the second light-emitting controlling transistor is connected to the first terminal of the light emitting device and the drain of the second light-emitting controlling transistor is connected to the drain of the driving transistor, wherein the second light-emitting controlling transistor is configured to control the light emitting device to emit the light, the driving transistor being configured to control, under the control of the light emitting control sub-circuit, the magnitude of the current flowing into the light emitting device.

9. The pixel driving circuit according to claim 7, wherein the first light-emitting controlling transistor and the second light-emitting controlling transistor are P-type thin-film transistors.

10. The pixel driving circuit according to claim 1, wherein the driving transistor is a P-type thin-film transistor.

11. A driving method of the pixel driving circuit according to claim 1, comprising:

in a resetting phase, resetting the voltages at the first terminal and the second terminal of the storage capacitor to the resetting signal line voltage and the data voltage, respectively, by the resetting sub-circuit;

in a data voltage writing phase, writing the data voltage into the second terminal of the storage capacitor by the data writing sub-circuit, and writing the compensation voltage into the first terminal of the storage capacitor by the compensating sub-circuit; and in a light emitting phase, transferring the data voltage to the gate of the driving transistor by the storage capacitor, the driving transistor being configured to control the magnitude of the current flowing into the light emitting device under the control of the light emitting control sub-circuit, so as to drive the light emitting device to emit the light.

12. The driving method according to claim 11, wherein, in the light emitting phase, the driving method further comprises: writing a compensation signal line voltage into the second terminal of the storage capacitor by the light emitting control sub-circuit, and transferring a difference between the compensation signal line voltage and the data voltage to the gate of the driving transistor by the storage capacitor, the driving transistor being configured to control the magnitude of the current flowing into the light emitting device under the control of the light emitting control sub-circuit, so as to drive the light emitting device to emit light.

13. The driving method according to claim 11, wherein, in the light emitting phase, the driving method further comprises: writing the first power supply voltage into the second terminal of the storage capacitor by the light emitting control sub-circuit, and transferring a difference between the first power supply voltage and the data voltage to the gate of the driving transistor by the storage capacitor, the driving transistor being configured to control, under the control of the light emitting control sub-circuit, the magnitude of the current flowing into the light emitting device, so as to drive the light emitting device to emit the light.

14. A display apparatus comprising the pixel driving circuit according to claim 1.

15. The display apparatus according to claim 14, wherein the data writing sub-circuit comprises a third transistor having a gate, a source, and a drain, wherein the gate of the third transistor is connected to the gate line, the source of the third transistor is connected to the data line, and the drain of the third transistor is connected to the second terminal of the storage capacitor, and wherein the third transistor is configured to write the data voltage into the second terminal of the storage capacitor.

16. The display apparatus according to claim 14, wherein the compensating sub-circuit comprises a compensating transistor having a gate, a source, and a drain, wherein the gate of the compensating transistor is connected to the gate line, the source of the compensating transistor is connected to the first terminal of the storage capacitor, and the drain of the compensating transistor is connected to the drain of the driving transistor, and wherein the compensating transistor is configured to write the compensation voltage into the first terminal of the storage capacitor.

17. The display apparatus according to claim 15, further comprising a compensation signal line, wherein the light emitting control sub-circuit comprises a light emitting control line, a first light-emitting controlling transistor, and a second light-emitting controlling transistor, wherein the first light-emitting controlling transistor has a gate, a source, and a drain, wherein the gate of the first light-emitting controlling transistor is connected to the light emitting control line, the source of the first light-emitting controlling transistor is connected to the compensation signal line, and the drain of the first light-emitting controlling transistor is connected to the second terminal of the storage capacitor, and is configured to write a compensation signal line voltage into the second terminal of the storage capacitor and transfer the compensation signal line voltage to the gate of the driving transistor by the storage capacitor, and wherein the second light-emitting controlling transistor has a gate, a source, and a drain, wherein the gate of the second light-emitting controlling transistor is connected to the light emitting control line, the source of the second light-emitting controlling transistor is connected to the first terminal of the light emitting device, and the drain of the second light-emitting controlling transistor is connected to the drain of the driving transistor, and is configured to control the light emitting device to emit light, the driving transistor being configured to control the magnitude of the current flowing into the light emitting device under the control of the light emitting control sub-circuit.

* * * * *